US005761905A

United States Patent [19]

Yamada et al.

[11] Patent Number: 5,761,905

[45] Date of Patent: Jun. 9, 1998

[54] EXHAUST MANIFOLD

[75] Inventors: Masahito Yamada; Eiji Nawata, both of Toyota, Japan

[73] Assignee: Aisin Takaoka Co., Ltd., Toyota, Japan

[21] Appl. No.: 785,284

[22] Filed: Jan. 23, 1997

[30] Foreign Application Priority Data

Jan. 25, 1996 [JP] Japan ..... 8-010812
Oct. 1, 1996 [JP] Japan ..... 8-280258

[51] Int. Cl.[6] ..... F01N 7/10

[52] U.S. Cl. ..... 60/322; 60/323

[58] Field of Search ..... 60/322, 323

[56] References Cited

U.S. PATENT DOCUMENTS 5,331,810 7/1994 Ingermann et al. .

FOREIGN PATENT DOCUMENTS 0 744 537 11/1996 European Pat. Off. .
3-35217 4/1991 Japan .

*Primary Examiner*—Douglas Hart
*Attorney, Agent, or Firm*—Burns, Doane, Swecker & Mathis, LLP

[57] ABSTRACT

An exhaust manifold has a plurality of double pipes, each of which includes an inner pipe and an outer pipe, and a collecting pipe to which each of the double pipes is connected. The outer peripheral portion of the outer pipe is secured to the collecting pipe, and a thermal insulating layer of air, which is formed as a closed space so that substantially no exhaust gas will penetrate it, is disposed on an inner peripheral side of the portion at which the outer periphery of the outer pipe is secured to the collecting pipe. Owing to the presence of the thermal insulating layer, heat is not transmitted to the welded joint directly via the inner and outer pipes.

13 Claims, 4 Drawing Sheets

EXHAUST MANIFOLD

FIELD OF THE INVENTION

This invention relates to an exhaust manifold used in the exhaust system of an internal combustion engine. More particularly, the invention relates to an exhaust manifold, which employs a double pipe (double shell pipe) as a branch pipe, used in the exhaust system of an internal combustion engine.

BACKGROUND OF THE INVENTION

Description of the Related Art

The exhaust system of an internal combustion engine uses an exhaust manifold to guide exhaust gas through the system. An exhaust manifold employing a double pipe has been developed in recent years. For example, see the specification of Japanese Utility Model Kokai Publication JP-UM-A-3-35217.

FIG. 7 illustrates the exhaust manifold disclosed in the above-mentioned specification. The exhaust manifold includes a double pipe fitted into a collecting pipe 103. The double pipe comprises an inner pipe 110 through which an exhaust gas is passed and an outer pipe 113 surrounding the inner pipe 110. The outer peripheral portion of the outer pipe 113 is welded to the end face of the collecting pipe 103 along its entire circumference. The welded joint is indicated at 152. The outer pipe 113 is bent inward at a point upstream of the welding portion 152 so as to contact the side of the inner pipe 110 and is bent outward again to the original diameter before being extended downstream. As a result of this construction, a closed space serving as an air thermal insulating layer is formed between the inner peripheral surface of the outer pipe 113 and the outer peripheral surface of the inner pipe 110 upstream of the portion at which the outer pipe 113 contacts the inner pipe 110. The outer peripheral surface of the outer pipe 113 is in contact with the inner peripheral surface of the collecting pipe 103 from the welded joint 152 to the downstream end of the outer pipe 113. The inner pipe 110 extends in parallel to the outer pipe 113 with a fixed spacing between them from a point somewhat upstream of the welded joint 152 to the downstream end of the inner pipe 110. Accordingly, the space between the inner peripheral surface of the outer pipe 113 situated on the inner peripheral side of the welded joint 152 and the outer peripheral surface of the inner pipe 110 is open and the exhaust gas flows into this open space.

When the internal combustion engine is operated, high-temperature (e.g., 700°–900° C.) exhaust gas passes through the inner pipe 110. As a result, the double pipe is heated by transfer of heat from the exhaust gas and undergoes thermal expansion. When the internal combustion engine is shut down, on the other hand, the flow of high-temperature exhaust gas ceases, allowing the double pipe to cool and thermally contract. Owing to the air thermal insulating layer formed in the exhaust manifold of FIG. 7, the exhaust gas can be guided to a catalytic converter while a drop in the temperature of the exhaust gas passing through the inner pipe 110 is suppressed. This is advantageous in that it assures that the exhaust gas will be purified efficiently.

In an exhaust manifold of the above-described type in which the double pipe is connected to the collecting pipe 103, it is believed that stress produced by thermal expansion and contraction concentrates most at the portion where the double pipe (the outer pipe thereof) and the collecting pipe are connected. In the exhaust manifold shown in FIG. 7, the space between the inner peripheral surface of the outer pipe 113 situated on the inner peripheral side of the welded joint 152 and the outer peripheral surface of the inner pipe 110 is open and the exhaust gas flows into this open space, as mentioned above. Consequently, this space essentially does not serve as an air thermal insulating layer and the welded joint 152 therefore is directly affected, via the outer pipe 113, by thermal expansion and contraction caused by the on-and-off flow of exhaust gas. This detracts from the durability of the welded joint 152, counted as a problem. Moreover, since the outer peripheral surface of the outer pipe 113 contacts the inner peripheral surface of the collecting pipe 103 over a comparatively large surface area from the welded joint 152 to the downstream end, the amount of heat transmitted from the outer pipe 113 to the collecting pipe 103 is large. Consequently, the change in the temperature of the welded joint 152 ascribable to the on-and-off flow of the exhaust gas becomes particularly pronounced, thereby contributing to the disadvantages decline in the durability of the welded joint 152. Furthermore, the welded joint 152 becomes overheated and the heat of the exhaust gas escapes to the outside, then the temperature of the exhaust gas that flows through the exhaust manifold declines. Such a drop in the temperature of the exhaust gas may diminish the activation of the catalyst provided downstream of the exhaust manifold.

Accordingly, there is a need to develop a structure exhibiting improved strength and durability of the welded joint at which the double pipe and collecting pipe are connected.

SUMMARY OF THE INVENTION

An object of the present invention is to provide an exhaust manifold exhibiting improved strength and durability of the welded joint at which the double pipe and collecting pipe are connected.

Further objects will become apparent from the entire disclosure.

The present invention provides an exhaust manifold characterized in that a thermal insulating layer is provided on the inner peripheral side of a portion at which a double pipe and a collecting pipe are welded together in such a manner that exhaust gas will not penetrate into the thermal insulating layer. Owing to the presence of the thermal insulating layer, heat is not transmitted to the welded joint directly via the inner and outer pipes, which are made of metal having a high degree of thermal conductivity. This suppresses overheating of the welded joint caused by the exhaust gas that flows intermittently through the interior of the double pipe as well as a decline in welding strength caused by a sudden change in temperature. Furthermore, since the heat of the exhaust gas does not readily radiate to the exterior of the exhaust manifold owing to the thermal insulating layer consisting of air, an excessive drop in the temperature of the exhaust gas is suppressed so that exhaust gas having a higher temperature is delivered to the catalyst situated downstream of the exhaust manifold.

According to a first aspect of the present invention, the foregoing object is attained by providing an exhaust manifold in which an outer peripheral portion of an outer pipe of at least one double pipe is secured to a collecting pipe, and an inner peripheral side of the zone at which the outer peripheral portion of the outer pipe is secured to the collecting pipe is provided with an insulating layer formed as a closed space in such a manner that substantially no exhaust gas will penetrate. It should be noted that the closed space in which substantially no exhaust gas penetrates is intended to cover not only a closed space that is completely sealed but also a closed space in which there is substantially no inflow of exhaust gas, even if the space is not completely sealed.

An exhaust manifold in which a plurality of double pipes are connected to a collecting pipe typically includes a plurality of double pipes each having an inner pipe through which exhaust gas passes, an outer pipe surrounding the inner pipe, and an insulating layer formed between the inner pipe and the outer pipe, and a collecting pipe, into which the plurality of double pipes are fitted, for collecting the exhaust gas that has passed through the inner pipes. As such an exhaust manifold, the exhaust manifold according to the first aspect of the invention is well suited.

In the first aspect of the invention, an exhaust manifold in a preferred embodiment comprises the following features: The outer pipe and inner pipe extend downstream from the zone at which the outer peripheral portion of the outer pipe is secured to the collecting pipe, and at least one of the outer pipe and inner pipe is enlarged or reduced in diameter so that the end of the outer pipe on the downstream side and the end of the inner pipe on the downstream side are brought into contact or into close proximity with each other to thereby form the thermal insulating layer. In accordance with this exhaust manifold, a space that is substantially closed to exhaust gas is formed/defined by the outer and inner pipes. This means that there is no need for a special member for closing the downstream end of the thermal insulating layer.

Further, in the first aspect of the invention, an exhaust manifold in a preferred embodiment comprises the following features: The outer pipe is gradually reduced in diameter to approach the inner pipe downstream of the zone at which the outer peripheral portion of the outer pipe is secured to the collecting pipe, and the inner peripheral surface of the outer pipe extends along the outer peripheral surface of the inner pipe via a minute clearance. In accordance with this exhaust manifold, it is much more difficult for exhaust gas to flow into the thermal insulating layer.

Further, in the first aspect of the invention, an exhaust manifold in a preferred embodiment comprises the following features: The end of the inner pipe on the downstream side thereof is extended downstream from the zone at which the outer peripheral portion of the outer pipe is secured to the collecting pipe, this end of the inner pipe being made a free end. In accordance with this exhaust manifold, thermal stress is absorbed by the expansion and contraction of the inner pipe that accompany the intermittent inflow of exhaust gas. This much more eliminates thermal stress acting upon the portion at which the double pipe and collecting pipe are welded together, as a result of which the strength of the weld is maintained. Furthermore, in a preferred embodiment, the inner pipe is supported by being held snugly by the outer pipe only on the upstream side.

Further, in the first aspect of the invention, an exhaust manifold in a preferred embodiment comprises the following features: The outer pipe is extended downstream from the zone at which the outer peripheral portion of the outer pipe is secured to the collecting pipe, and the downstream end of the outer pipe is spaced away from the collecting pipe. In accordance with this exhaust manifold, it is difficult for exhaust gas to flow into the gap between the outer pipe and the collecting pipe even when the outer pipe is reduced in diameter to form the thermal insulating layer between the downstream end of the outer pipe, which is the portion of reduced diameter, and the inner pipe. As a result, overheating of the welded joint, sudden changes in temperature and an excessive drop in exhaust gas temperature are suppressed.

Further, in the first aspect of the invention, an exhaust manifold in a preferred embodiment comprises the following features: The exhaust manifold has a flange provided with a connection hole (bore), the connection hole has a step portion formed to have an end face extending radially of the connection hole; The end portion of the double pipe on the upstream side thereof is fitted into the connection hole in such a manner that the end face of at least the outer pipe on the upstream side thereof abuts against the end face of the step portion, in which state the outer peripheral surface of the outer pipe is secured to the flange; And the outer peripheral surface of the inner pipe and the inner peripheral surface of the outer pipe is in contact inside the connection hole so that the inner pipe is held snugly by the outer pipe.

According to a second aspect of the present invention, the foregoing object is attained by providing an exhaust manifold having the following features: The exhaust manifold comprises: a plurality of double pipes, each of which has an inner pipe having a passageway through which exhaust gas passes, an outer pipe surrounding the inner pipe and an air insulating layer formed between the inner pipe and the outer pipe, and a collecting pipe connected to each double pipe for collecting the exhaust gas that passes through the passageway of the inner pipe of each double pipe; In this arrangement the outer pipe of at least one of the double pipes has an inner diameter reduced at a downstream end thereof so as to equal or approach the outer diameter of the inner pipe at the downstream end thereof, and a supporting pipe portion which supports the downstream end of the inner pipe; and a portion of the outer pipe to be welded, which portion is located upstream of the pipe supporting portion of the outer pipe, is secured to the collecting pipe by a welded joint; wherein the air insulating layer is disposed, in a transverse cross section of the double pipe along the radial direction thereof, on the inner diameter side of the portion of the outer pipe to be welded. In a preferred embodiment of the second aspect of the invention, the outer pipe supports the inner pipe in a nonrigid structure by the supporting pipe portion.

According to a third aspect of the present invention, the foregoing object is attained by providing an exhaust manifold having the following features: The exhaust manifold comprises a plurality of double pipes, each of which has an inner pipe having a passageway through which exhaust gas passes, an outer pipe surrounding the inner pipe and an air insulating layer formed between the inner pipe and the outer pipe; and a collecting pipe connected to each double pipe for collecting the exhaust gas that passes through the passageway of the inner pipe of each double pipe. In this arrangement, the inner pipe of at least one of the double pipes has an outer diameter enlarged at a downstream end thereof so as to equal or approach the inner diameter of the outer pipe at the downstream end thereof, and a supporting pipe portion supported on the downstream end of the outer pipe; and a portion of the outer pipe to be welded, which portion is located upstream of the pipe supporting portion of the inner pipe, is secured to the collecting pipe by a welded joint; wherein the air insulating layer is disposed, in a transverse cross section of the double pipe along the radial direction thereof, on the inner diameter side of the portion of the outer pipe to be welded. In a preferred embodiment of the third aspect of the invention, the inner pipe is supported in the outer pipe in a nonrigid structure by the supporting pipe portion.

In accordance with the exhaust manifolds of the second and third aspects of the invention, the thermal insulating layer consisting of air is disposed on the inner diameter side of the portion of the outer pipe to be welded in a transverse cross section taken along the radial direction of the double pipe. As a result, the heat of the high-temperature exhaust gas that travels through the inner pipe is not directly transmitted to the portion of the outer pipe that is to be welded, by reason of which a rise in the temperature of the portion of the outer pipe to be welded is suppressed as well as the overheating thereof. This in turn suppresses a rise in the temperature of the welded joint and the overheating thereof.

Other features and advantages of the present invention will be apparent from the following description taken in conjunction with the accompanying drawings, in which like reference characters designate the same or similar parts throughout the figures thereof.

DESCRIPTION OF THE PREFERRED EMBODIMENTS

Preferred embodiments of the present invention will now be described with reference to the drawings.

[First Embodiment]

Figure 1:
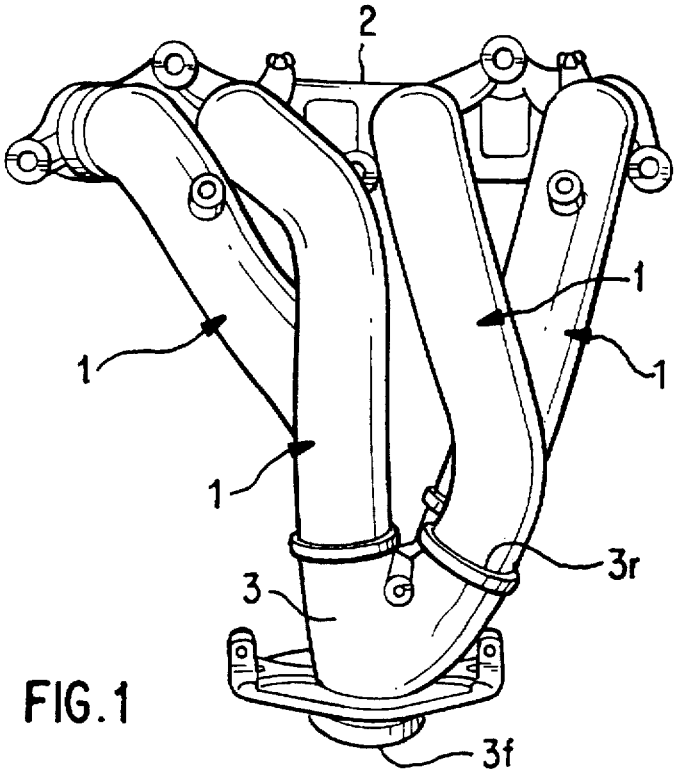
FIG. 1 is a perspective view of an exhaust manifold according to a first embodiment of the invention.
Figure 2:
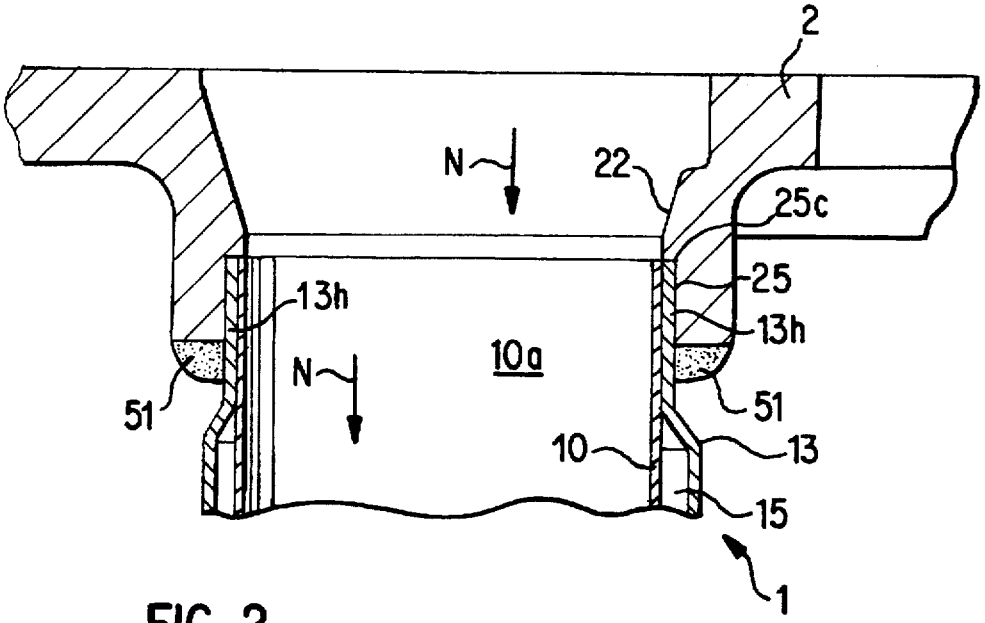
FIG. 2 is a sectional view illustrating a joint portion between a flange and a double pipe of an exhaust manifold according to the first embodiment of the present invention.
Figure 3:
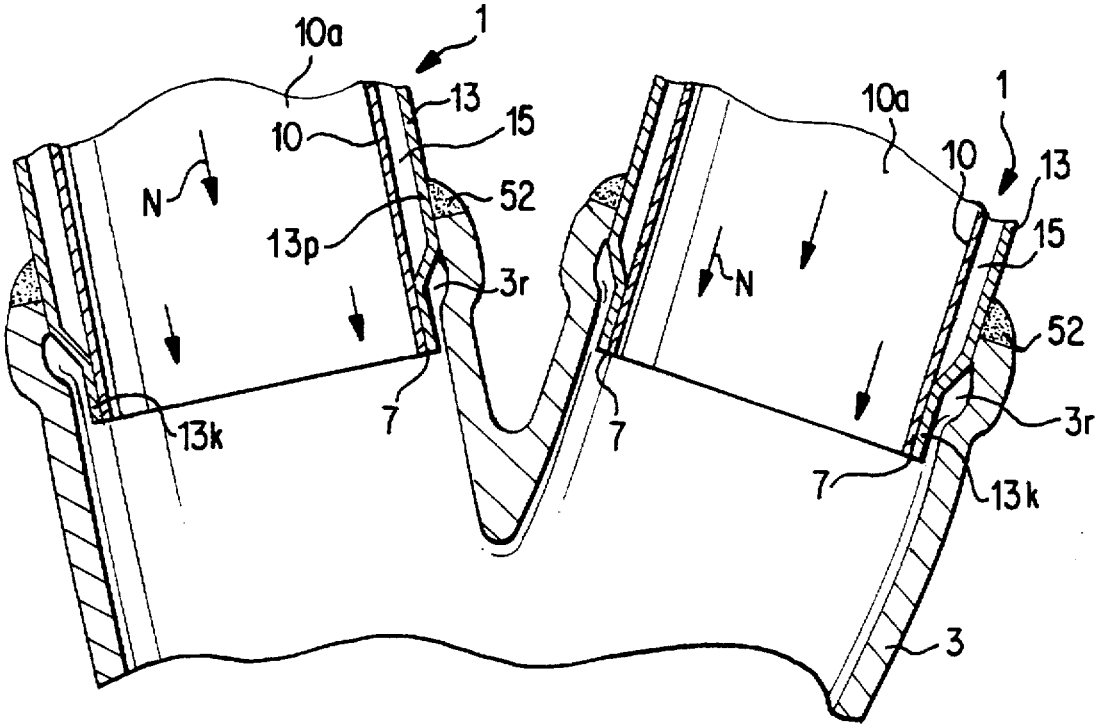
FIG. 3 is a sectional view illustrating a joint portion between a collecting pipe and the double pipe of the exhaust manifold according to the first embodiment of the present invention.
Figure 4:
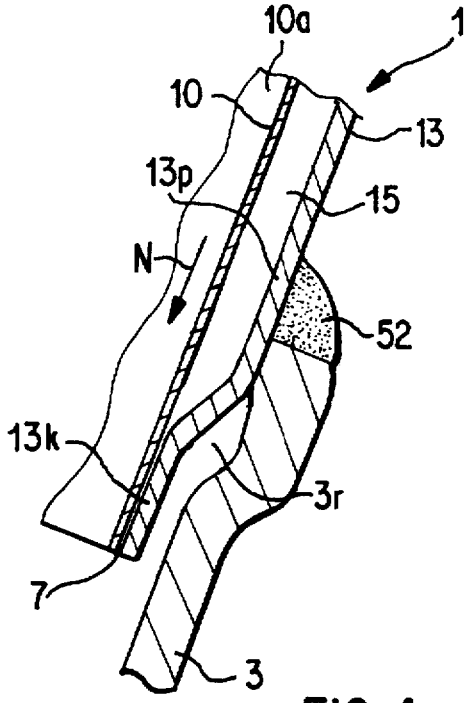
FIG. 4 is a sectional view of a principal portion showing, in enlarged form, the joint portion between the collecting pipe and the double pipe of the exhaust manifold according to the first embodiment of the present invention.

FIG. 1 is a perspective view for describing the overall structure of an exhaust manifold according to a first embodiment of the invention, FIG. 2 is a sectional view, taken in the radial direction, for describing the connection structure between a flange and a double pipe on the upstream side in the exhaust manifold of FIG. 1, FIG. 3 is a sectional view, taken in the radial direction, for describing the connection structure between a collecting pipe and the double pipe on the downstream side in the exhaust manifold of FIG. 1, and FIG. 4 is an enlarged view of the principal portion of FIG. 3. It should be noted that the arrows N in these drawings indicate the direction in which exhaust gas flows.

The exhaust manifold shown in FIG. 1 through 4 includes a plurality of double pipes 1 communicating with a plurality of exhaust ports of an internal combustion engine, and a collecting pipe 3, to which the plurality of double pipes 1 are connected, for collecting exhaust gas. More specifically, the exhaust manifold includes the plurality of double pipes 1, a flange 2, made of cast iron, to which each of the plurality of double pipes 1 is connected by having its upstream end inserted into the flange, and the collecting pipe 3, made of cast iron, to which each of the plurality of double pipes 1 is connected by having its downstream end inserted into the collecting pipe. Each double pipe 1 is composed of a stainless steel inner pipe 10 and a stainless steel outer pipe 13 into which the inner pipe 10 is substantially coaxially inserted. The inner pipe 10 is held/fitted snugly (tightly interposed or sandwiched) by the outer pipe 13 by bringing the outer peripheral surface of the inner pipe 10 and the inner peripheral surface of the outer pipe 13 into abutting contact at the upstream end of the inner pipe 10 and outer pipe 13 (see FIG. 2). Furthermore, the inner pipe 10 has a smaller wall thickness than the outer pipe 13. An air thermal insulating layer 15 continuous in the circumferential and axial directions of the double pipe 1 (i.e., continuous about the circumference and from the upstream end to the downstream end) is formed between the inner pipe 10 and outer pipe 13 (see FIGS. 2 through 4). As will be described later, a drop in the temperature of the exhaust gas, overheating of a welded joint and sudden change in temperature are suppressed by the adiabatic function of the thermal insulating layer 15 consisting of air. The width of the gap defined by the insulating layer 15 can be selected as required, with a typical example of the width being 2~3 mm. The collecting pipe 3 has a discharge port 3*f* that collects and discharges the exhaust gas. A catalyst (not shown) is disposed downstream of the discharge port 3*f*.

The connection structure between the upstream end of the double pipe 1 and the flange 2 will be described with reference to FIG. 2. The outer pipe 13 is gradually reduced in diameter at its upstream end to form a constricted portion and has a small-diameter portion 13*h*, the diameter of which is substantially constant, upstream of the gradually constricted portion. The outer peripheral surface of the upstream end of the inner pipe 10 inserted into the outer pipe 13 is brought into abutting contact with the inner peripheral surface of the small-diameter portion 13*h* of outer pipe 13. Accordingly, the small-diameter portion 13*h* of the outer pipe 13 serves as a pipe supporting portion for the inner pipe 10. The inner pipe 10 is held snugly (or secured) in the outer pipe 13 by means of the small-diameter portion 13*h*. The flange 2 is formed to have a plurality of connection holes 22 for connecting the double pipes 1. The inner surface of each connection hole 22 is formed to include a mounting step 25 having an end face 25*c* extending radially of the connection hole 22. The upstream end faces of the inner pipe 10 and outer pipe 13 are in abutting contact with the end face 25*c*. It will suffice if the upstream end face of at least the outer pipe 13 is axially positioned to abut against the end face 25*c* of the mounting step 25. Since the inner pipe 10 is held snugly (or secured) in the outer pipe 13, the upstream end face of the inner pipe 10 need not abut against the end face 25*c*. With the upstream end face of the outer pipe 13 being abutted against the end face 25*c* of the mounting step 25, the outer peripheral surface of the outer pipe 13 is build-up welded, along its entire circumference, to the end face in the opening of the connection hole 22 (this welded joint shall be referred to as a first welded joint 51), whereby the double pipe 1 is connected to the flange 1.

The structure of the connection between the downstream end of the double pipe 1 and the collecting pipe 3 will be described with reference to FIG. 3. The double pipe 1 is inserted into a connection hole 3*r* of the collecting pipe 3 in such a manner that the upstream end extends into the exhaust gas. In this state the outer peripheral surface of the outer pipe 13 and the end face of the collecting pipe 3 are build-up welded together along the entire circumference (this welded joint is referred to as a second welded joint 52, and the portion of the outer pipe 13 that is to be welded is indicated at 13*p*). The terminus of the connection hole 3*r* has a diameter slightly larger than that of the base portion thereof. Inside the collecting pipe 3 the outer pipe 13 is gradually reduced in diameter downstream of the welding portion 13*p* and has a small-diameter portion 13*k*, the diameter of which is substantially constant, downstream of its gradually constricted portion. The inner pipe 10 is gradually extended with its diameter being kept substantially fixed, and the outer peripheral surface of the inner pipe 10 at its downstream end is brought close to the inner peripheral surface of the small-diameter portion 13*k* of the outer pipe 13 with a small clearance 7 lying between these two surfaces. The width of the clearance 7 is 0.8 mm or less (preferably 0.4 mm or less). It should be noted that a contacting arrangement may be adopted in which the outer peripheral surface of the inner pipe 10 at its downstream end and the inner peripheral surface of the small-diameter portion 13*k* of the outer pipe 13 touch each other with zero clearance between them. In either arrangement, there is substantially no inflow of exhaust gas from between the inner pipe 10 and outer pipe 13. In other words, the downstream end of the thermal insulating layer 15 of air is substantially sealed. The downstream end of the inner pipe 10 is a free end that readily expands and contracts longitudinally of the inner pipe 10. As shown in FIG. 2, the inner pipe 10 is held snugly in the outer pipe 13 because the outer peripheral surface of the inner pipe 10 at its upstream end is in abutting contact with the inner peripheral surface of the outer pipe 13, whereby the inner pipe 10 is acted upon by a retaining force. As a result, the inner pipe 10 is held by the outer pipe 13 on the upstream side of the inner pipe 10.

By virtue of the minute clearance 7 or the zero-clearance contact between the inner pipe 10 and outer pipe 13, the downstream end of the inner pipe 10 can be construed as being nonrigidly supported by the small-diameter portion 13*k* of the outer pipe 13 on its downstream side. Accordingly, the small-diameter portion 13*k* may be construed as being a pipe supporting portion for supporting the inner pipe 10 by a nonrigid structure.

The function of the exhaust manifold described above will now be set forth with reference to FIGS. 1 through 4.

When high-temperature exhaust gas discharged intermittently from the plurality of exhaust ports of the internal combustion engine flows through each passageway 10*a*, the heat of the exhaust gas is transmitted indirectly to the second welded joint 52, at which the double pipe 1 has been welded to the collecting pipe 3, via the thermal insulating layer 15 present on the inner peripheral side of the second welded joint 52. Since the thermal conductivity of the air constituting the thermal insulating layer 15 is lower than the metal constituting the inner pipe 10 and outer pipe 13, overheating of the second welded joint 52 and a sudden rise in temperature caused by the exhaust gas are prevented. The durability of the second welded joint 52 is improved as a result. In addition, since a decline in the temperature of the exhaust gas is suppressed by the thermal insulating layer 15 of air, the catalyst located downstream of the exhaust manifold can be activated sooner.

Furthermore, owing to the minute clearance 7 or zero-clearance contact between the inner pipe 10 and outer pipe 13, the downstream end of the inner pipe 10 is a free end that readily expands and contracts longitudinally of the inner pipe 10. As a result, the inner pipe 10 expands and extracts with the intermittent inflow of the exhaust gas. The expansion and contraction of the inner pipe 10 makes it possible to absorb the thermal stress produced by a difference in the amount of thermal expansion or amount of thermal contraction between the inner pipe 10 and outer pipe 13 brought about by the intermittent inflow of exhaust gas that results from operating and shutting down the internal combustion engine. Hence there is less tendency for thermal stress to act upon the second welded joint 52. Accordingly, the welding strength of the second welded joint 52 is maintained and the durability of the exhaust manifold is enhanced.

The stress ascribed to thermal expansion or thermal contraction concentrates mostly in the welded joint between the double pipe 1 and collecting pipe 3. The durability of the second welded joint 52 is influenced by the temperature of the surroundings in which the manifold is used and by a change in temperature. In this regard the present embodiment is such that even though the high-temperature exhaust gas flows into the passageway 10*a* of the inner pipe 10, overheating of the welding portion 13*p* of outer pipe 13 and of the second welded joint 52 and a sudden change in the temperature of these portions are suppressed by the air insulating layer 15. Accordingly, an advantage of this embodiment is assured strength and durability of the second welded joint 52, which is the joint at which the double pipe 1 and collecting pipe 3 are connected together.

The thermal insulating layer 15 performing the function described above can be formed through a simple structure merely by gradually reducing the diameter of the downstream end of the outer pipe 13 to provide the outer pipe 13 with the small-diameter portion 13*k* corresponding to the outer diameter of the inner pipe 10.

Further, extending the double pipe 1 (the inner pipe 10 and outer pipe 13) from the second welded joint 52 to a point downstream of the enlarged-diameter portion of the connection hole 3*r* inside the collecting pipe 3 makes it difficult for the exhaust gas to flow in between the outer peripheral surface of the downstream end of outer pipe 13 and the inner peripheral surface of the somewhat enlarged portion of the connection hole 3*r*. This makes it possible to suppress overheating of the second welded joint 52 and radiation of heat from the exhaust gas.

Further, by providing the clearance 7 between the inner pipe 10 and outer pipe 13 in a preferred arrangement, the inner pipe 10 is prevented from contacting the outer pipe 13 with excessive pressing force.

Figure 6:
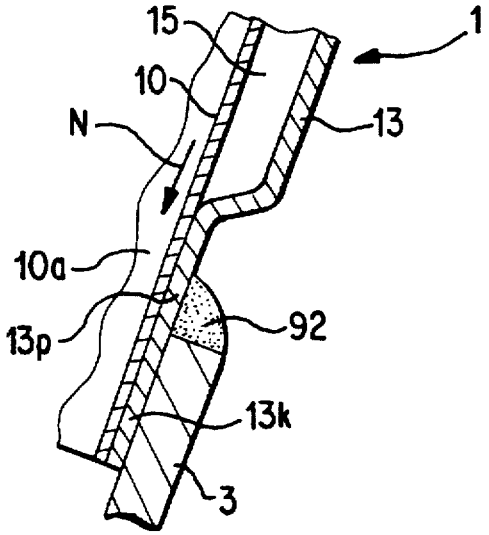
FIG. 6 is a sectional view illustrating a joint portion between a collecting pipe and a double pipe of an exhaust manifold according to an example for the purpose of comparison.
Figure 7:
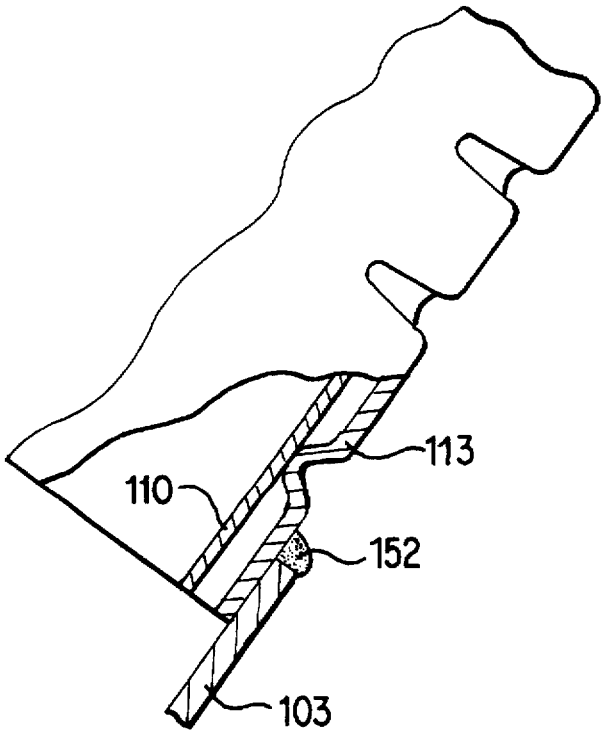
FIG. 7 is a sectional view showing the joint portion between a collecting pipe and a double pipe of an exhaust manifold according to the prior art.

An exhaust manifold according to an example for the purpose of comparison will now be described. FIG. 6 is a radial sectional view for describing the connection between the double pipe 1 and collecting pipe 3 in an exhaust manifold according to this comparative example. In the exhaust manifold of the comparative example illustrated in FIG. 6, the outer pipe 13 is gradually reduced in diameter in the direction of the inner pipe 10 to form a small-diameter portion (the pipe supporting portion) 13*k* upstream of the portion at which the outer pipe 13 is welded to the collecting pipe 3 (where a build-up welded portion is referred to as a third welded joint 92 and the portion of the outer pipe 13 that is to be welded is indicated at 13*p*), the inner peripheral surface of the small-diameter portion 13*k* of the outer pipe 13 and the outer peripheral surface of the inner pipe 10 are in abutting contact, and the outer pipe 13 and inner pipe 10 are extended further in the downstream direction in the state in which they are in contact with each other. Downstream of the third welded joint 92 the outer peripheral surface of the inner pipe 10 and the inner peripheral surface of the outer pipe 13 are in abutting contact, and so are the outer peripheral surface of the outer pipe 13 and the inner peripheral surface of the collecting pipe 3.

In the case of this comparative example, the thermal insulating layer 15 of air formed between the inner pipe 10 and the outer pipe 13 does not reach the third welded joint 92. That is, the thermal insulating layer 15 of air is not formed radially inward of (on the inner peripheral side of) the welded joint 92. Consequently, when the high-temperature exhaust gas flows through the passageway 10*a* inside the inner pipe 10, the heat of the high-temperature exhaust gas is directly transmitted to the welding portion 13*p* of the outer pipe 13 via the inner pipe 10 and outer pipe 13, which exhibit high thermal conductivity. In accordance with the arrangement of the comparative example, therefore, the welded joint 92 undergoes a major rise in temperature and is rapidly overheated. The result is that the welded joint 92 tends to lose strength and durability. Further, with the exhaust manifold of the comparative example, the outer peripheral surface of the inner pipe 10 and the inner peripheral surface of the outer pipe 13 contact each other and so do the outer peripheral surface of the outer pipe 13 and the inner peripheral surface of the collecting pipe 3 downstream of the welded joint 92. Since the degree of freedom the inner pipe 10 has to expand and contract is thus diminished, the inner pipe 10 is less able to absorb the thermal stress produced by the intermittent inflow of the exhaust gas.

[Second Embodiment]

Figure 5:
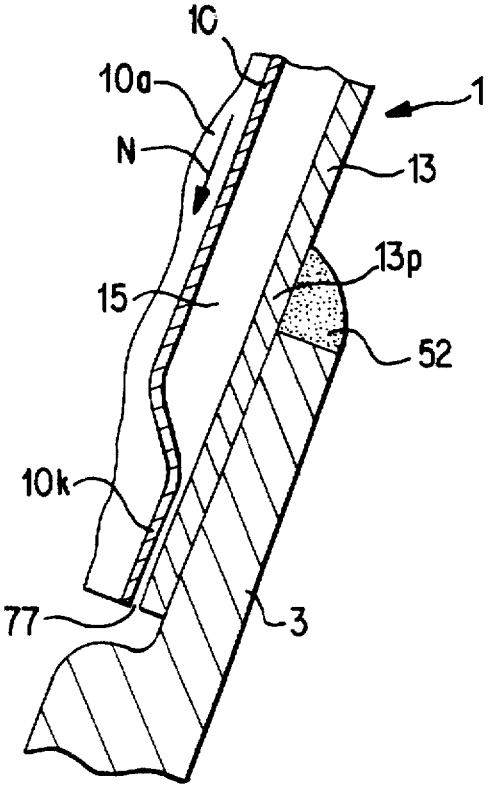
FIG. 5 is a sectional view illustrating a joint portion between a collecting pipe and a double pipe of an exhaust manifold according to a second embodiment of the present invention.

FIG. 5 illustrates the principal portion (the connection between the double pipe 1 and the collecting pipe 3) of a second embodiment of the present invention. This embodiment basically is similar in structure to the first embodiment and basically the similar actions and effects are obtained. The description will focus on the feature that distinguishes this embodiment from the first embodiment.

In the second embodiment of the invention, as shown in FIG. 5, the inner pipe 10 at the downstream end of the double pipe 1 is gradually enlarged in diameter toward the outer pipe 13 and has a large-diameter portion 10*k* downstream of its gradually enlarged portion. The large-diameter portion 10*k* extends along the inner peripheral surface of the outer pipe 13 through the intermediary of a minute clearance 77. As mentioned earlier, an arrangement may be adopted in which the outer peripheral surface of the inner pipe 10 and the inner peripheral surface of the outer pipe 13 are in contact with zero clearance between them. In either arrangement, there is substantially no inflow of exhaust gas from between the inner pipe 10 and outer pipe 13. In other words, the downstream end of the thermal insulating layer 15 of air is substantially sealed. The downstream end of the inner pipe 10 is a free end that readily expands and contracts longitudinally of the inner pipe 10.

By virtue of the minute clearance 7 or the zero-clearance contact between the inner pipe 10 and outer pipe 13, large-diameter portion 10*k* on the downstream side of the inner pipe 10 can be construed as being nonrigidly supported by the inner peripheral surface of the outer pipe 13 at the downstream end thereof. Accordingly, the large-diameter portion 10*k* on the downstream side of the inner pipe 10 may be construed as being a pipe supporting portion at which the inner pipe 10 is supported by a nonrigid structure.

In the second embodiment of FIG. 5 also the thermal insulating layer 15 consisting of air is disposed on the inner peripheral side of the second welded joint 52 (on the inner diameter side of the welding portion 13*p* of outer pipe 13). As a result, the heat of the high-temperature exhaust gas is not transmitted directly to the welding portion 13*p*. Hence, a rise in the temperature of the welding portion 13*p* of the outer pipe 13 and the overheating thereof are suppressed. This in turn suppresses a rise in temperature and overheating of the second welded joint 52. An excessive decline in the temperature of the exhaust gas caused by passage of the exhaust gas through the exhaust manifold is suppressed as well. Since the downstream end of the inner pipe 10 is a free end, the influence of any difference in amount of thermal expansion or thermal contraction between the inner pipe 10 and outer pipe 13 is mitigated or avoided. This contributes to maintain and enhance the strength of the portion at which the double pipe 1 and collecting pipe 3 are connected, namely the second welded joint 52, where stress is most likely to concentrate.

Thus, in the embodiments described above, either the inner pipe or outer pipe of the double pipe is enlarged or reduced in diameter downstream of the connection between the double pipe and the collecting pipe. However, it is also possible to adopt an arrangement in which the inner pipe is enlarged in diameter and the outer pipe reduced in diameter.

In the following, the meritorious effects of the present invention will be summarized, without restrictive purpose.

In accordance with the exhaust manifold of the present invention, an insulating layer is provided on the inner peripheral side of the welded joint connecting a double pipe and a collecting pipe. This makes it possible to suppress a sudden temperature rise and overheating of the weld at which the double pipe and collecting pipe are connected and in which stress readily concentrates. The result is that the strength of the weld is maintained and the durability of the welded joint is improved. Accordingly, the invention contributes to an increase in the service life of the exhaust manifold.

According to a preferred embodiment, the thermal insulating layer is provided through a simple structure by enlarging or reducing the diameter of at least one of the outer pipe and inner pipe and bringing the downstream end of the outer pipe and the downstream end of the inner pipe into abutting contact or into close proximity with each other. By making the downstream end of the inner pipe a free end, thermal stress caused by a difference in the amount of thermal expansion or thermal contraction between the inner pipe and outer pipe is absorbed by expansion and contraction of the downstream end of the inner pipe. This makes it difficult for thermal stress to concentrate in the welded joint. Further, the outer pipe is extended downstream of the area at which the outer peripheral portion of the outer pipe is secured to the collecting pipe. As a result, even though the outer pipe is reduced in diameter to form the downstream end of the outer pipe into a reduced-diameter portion and the insulating layer is formed between the inner pipe and the outer pipe, it is difficult for exhaust gas to flow into the clearance between the outer pipe and collecting pipe. This makes it possible to suppress the overheating of the welded joint, a sudden change in temperature thereof and an excessive drop in the temperature of the exhaust gas.

As many apparently widely different embodiments of the present invention can be made without departing from the spirit and scope thereof, it is to be understood that the invention is not limited to the specific embodiments thereof except as defined in the appended claims.

What is claimed is:

1. An exhaust manifold comprising:

a plurality of double pipes each having an inner pipe through which exhaust gas passes, an outer pipe surrounding said inner pipe, and a thermal insulating layer formed between said inner pipe and said outer pipe; and a collecting pipe, into which said plurality of double pipes are fitted, for collecting the exhaust gas that has passed through said inner pipes;

wherein, in at least one of said double pipes, an outer peripheral portion of said outer pipe is secured to said collecting pipe; and said thermal insulating layer, which is formed as a closed space so that substantially no exhaust gas will penetrate therein, is disposed on an inner peripheral side of a zone at which the outer peripheral portion of said outer pipe is secured to said collecting pipe.

2. The exhaust manifold according to claim 1, wherein said outer pipe and said inner pipe extend downstream from the zone at which the outer peripheral portion of said outer pipe is secured to said collecting pipe, and at least one of said outer pipe and said inner pipe is enlarged or reduced in diameter so that the end of said outer pipe on the downstream side and the end of said inner pipe on the downstream side are brought into contact or into close proximity with each other to thereby form said thermal insulating layer.

3. The exhaust manifold according to claim 2, wherein said outer pipe is gradually reduced in diameter to approach said inner pipe downstream of the zone at which the outer peripheral portion of said outer pipe is secured to said collecting pipe, and the inner peripheral surface of said outer pipe extends along the outer peripheral surface of said inner pipe via a minute clearance.

4. The exhaust manifold according to claim 1, wherein the end of said inner pipe on a downstream side thereof is extended downstream from the zone at which the outer peripheral portion of said outer pipe is secured to said collecting pipe, this end of the inner pipe being made a free end.

5. The exhaust manifold according to claim 1, wherein said outer pipe is extended downstream from the zone at which the outer peripheral portion of said outer pipe is secured to said collecting pipe, and the downstream end of said outer pipe is spaced away from said collecting pipe.

6. The exhaust manifold according to claim 1, further comprising a flange provided with a connection hole, said connection hole having a step portion formed to have an end face extending radially of the connection hole;

the end portion of said double pipe on the upstream side thereof being fitted into the connection hole in such a manner that the end face of at least said outer pipe on the upstream side thereof abuts against the end face of the step portion, in which state the outer peripheral surface of said outer pipe is secured to said flange;

the outer peripheral surface of said inner pipe and the inner peripheral surface of said outer pipe being in contact inside the connection hole so that said inner pipe is held snugly by said outer pipe.

7. An exhaust pipe according to claim 1, wherein said outer pipe is secured to said collecting pipe by welding.

8. An exhaust pipe according to claim 6, wherein said step portion of the flange is configured in such a manner that allows said inner pipe to expand and contract.

9. An exhaust pipe according to claim 6, wherein said outer pipe is secured to said flange by welding.

10. An exhaust manifold, comprising:

a plurality of double pipes, each of which has an inner pipe having a passageway through which exhaust gas passes, an outer pipe surrounding said inner pipe and a thermal insulating layer consisting of air formed between said inner pipe and said outer pipe; and a collecting pipe connected to each double pipe for collecting the exhaust gas that passes through the passageway of said inner pipe of each double pipe;

wherein, in at least one of said double pipes, said outer pipe has an inner diameter reduced at a downstream end thereof so as to equal or approach the outer diameter of said inner pipe at the downstream end thereof, and a supporting pipe portion which supports the downstream end of said inner pipe;

a portion of said outer pipe that is to be welded, which portion is located upstream of the pipe supporting portion of said outer pipe, being secured to said collecting pipe by a welded joint;

said thermal insulating layer being disposed, in a transverse cross section of said double pipe along the radial direction thereof, on the inner diameter side of the portion of said outer pipe that is to be welded.

11. An exhaust pipe according to claim 10, wherein said inner pipe is held snugly in a nonrigid structure by said outer pipe at said pipe supporting portion.

12. An exhaust manifold, comprising:

a plurality of double pipes, each of which has an inner pipe having a passageway through which exhaust gas passes, an outer pipe surrounding said inner pipe and a thermal insulating layer consisting of air formed between said inner pipe and said outer pipe; and a collecting pipe connected to each double pipe for collecting the exhaust gas that passes through the passageway of said inner pipe of each double pipe;

wherein, in at least one of said double pipes, said inner pipe has an outer diameter enlarged at a downstream end thereof so as to equal or approach the inner diameter of said outer pipe at the downstream end thereof, and a supporting pipe portion supported on the downstream end of said outer; pipe;

a portion of said outer pipe that is to be welded, which portion is located upstream of the pipe supporting portion of said inner pipe, being secured to said collecting pipe by a welded joint;

said thermal insulating layer being disposed, in a transverse cross section of said double pipe along the radial direction thereof, on the inner diameter side of the portion of said outer pipe that is to be welded.

13. An exhaust pipe according to claim 12 wherein said inner pipe is held snugly in a nonrigid structure by said outer pipe at said pipe supporting portion.

* * * * *